US005947712A

United States Patent [19]

Viegas et al.

[11] Patent Number: 5,947,712

[45] Date of Patent: Sep. 7, 1999

[54] HIGH EFFICIENCY ROTARY VANE MOTOR

[75] Inventors: Herman H. Viegas, Bloomington; Bruce E. McClellan, Richfield, both of Minn.

[73] Assignee: Thermo King Corporation, Minneapolis, Minn.

[21] Appl. No.: 08/837,037

[22] Filed: Apr. 11, 1997

[51] Int. Cl.[6] ..... F01C 1/344

[52] U.S. Cl. ..... 418/152; 418/179; 418/259; 418/268

[58] Field of Search ..... 418/152, 179, 418/259, 268

[56] References Cited

U.S. PATENT DOCUMENTS

| | | | |
|---|---|---|---|
| 1,014,162 | 1/1912 | McCormick | 418/268 |
| 1,942,784 | 1/1934 | Terrill | 418/268 |
| 2,150,122 | 3/1939 | Kollberg et al. | 418/179 |
| 3,598,510 | 8/1971 | Aoki | 418/268 |
| 4,376,620 | 3/1983 | Colston | 418/152 |
| 4,505,649 | 3/1985 | Masuda et al. | 418/259 |
| 4,615,663 | 10/1986 | Iio et al. | 418/179 |
| 4,846,122 | 7/1989 | Kristof et al. | 418/152 |
| 4,859,162 | 8/1989 | Cox | 418/179 |
| 5,087,180 | 2/1992 | Clapp | 418/179 |

FOREIGN PATENT DOCUMENTS

| | | | |
|---|---|---|---|
| 0022103 | 1/1981 | European Pat. Off. | 418/152 |
| 78301 | 12/1970 | Germany | 418/152 |
| 2752233 | 8/1979 | Germany . | |
| 2-11885 | 1/1990 | Japan | 418/268 |
| 2-91401 | 3/1990 | Japan | 418/152 |
| 2-136586 | 5/1990 | Japan | 418/179 |
| 6-129366 | 5/1994 | Japan | 418/179 |
| 2014507 | 6/1994 | Russian Federation | 418/268 |
| 667140 | 2/1952 | United Kingdom | 418/268 |

*Primary Examiner*—John J. Vrablik
*Attorney, Agent, or Firm*—Michael M. Gnibus

[57] ABSTRACT

A rotary vane motor for efficiently extracting mechanical energy from an expanding gas at low rotational speeds is provided. The motor includes a housing having a cylindrical enclosure, a rotor having a plurality of radially oriented slots, a plurality of vanes slidably movable in the slots, a shaft for rotatably mounting the rotor in an eccentric position within the housing enclosure, and a slidable connection between the rotor and the shaft for equilibrating close clearances between the rotor and the side edges of the vanes and the inner surfaces of the housing to minimize inefficiencies due to blow-by and friction. Additionally, the materials forming the rotor, the vanes, and the housing are all selected to have the same thermal coefficient of expansion so that the vanes tightly interfit within their respective slots and the sealing surfaces of the housing over a temperature range spanning the cryogenic temperatures associated with the prefeffed drive gas, and maximum ambient temperatures. Finally, gas conducting structures in either the rotor or the vanes are provided for admitting a portion of the drive gas to the inner edges of the vanes to radially push the outer edges into tight sealing engagement with the inner surfaces of the housing.

12 Claims, 5 Drawing Sheets

HIGH EFFICIENCY ROTARY VANE MOTOR

BACKGROUND OF THE INVENTION

This invention generally relates to rotary vane motors, and is specifically concerned with a rotary vane motor for effectively extracting mechanical energy from an expanding, cryogenic gas at low rotational speeds.

Rotary vane motors are known in the prior art. Such motors typically comprise a housing having a cylindrical interior, and a cylindrical rotor eccentrically mounted in the interior of the housing. The rotor includes a plurality of uniformly spaced, radially oriented slots for slidably receiving a plurality of rectangularly shaped vanes. Both the housing and the rotor are typically formed of metal. The eccentric placement of the rotor within the cylindrical enclosure defined by the housing leaves a gap between the rotor and the housing that is crescent-shaped in cross section. In operation, pressurized fluid (usually compressed air) is admitted in an inlet port in the housing located at one of the narrow ends of the crescent-shaped gap. The pressurized fluid pushes against the trailing faces of the slidable vanes, thereby rotating the rotor. Centrifugal force radially slings the vanes out of their slots such that their outer edges sealingly engage the inner surface of the housing. The vanes reciprocate in their respective slots as their outer edges sealingly and slidably engage the interior surface of the housing. The pressurized fluid is expelled out an outlet port located at the other end of the crescent-shaped gap.

Such prior art rotary-vane motors are well adapted for powering tools such as pneumatic wrenches and grinders where the operating speeds of the motor shaft are greater than 2000 rpm, and where a pressurized drive fluid in the form of a supply of compressed and lubricant-containing air is plentifully and cheaply supplied by the shop air compressor. While there is a certain loss of efficiency in such designs due to the leakage (or "blow-by") of compressed air between the sides of the rotating vanes and the sidewalls of the housing, the inefficiencies created by such blow-by are relatively small as a percentage of the overall air mass that flows through the motor at speeds of 2000 rpm or greater. Moreover, the entrained oil or other lubricant typically present in the shop air used to drive such motors keeps the internal friction of the motor down to a useable level.

The applicants have observed, however, that such prior art motor designs are not well suited for use at relatively low rotational speeds (i.e., under 1500 rpm), and under conditions where the drive fluid contains no lubricant or moisture, and is cryogenically generated. Such an application for a rotary vane motor may occur, for example, in a cryogenic refrigeration system powered by a tank of liquified carbon dioxide, such as that disclosed in co-pending Ser. No. 08/501,372, filed Jul. 12, 1995, also assigned to the Thermo King Corporation of Minneapolis, Minn. In such an application, the motor is used to drive an evaporator blower and an alternator to recharge the battery that powers the refrigeration control system, and low rotational speeds are preferred to enhance the efficiency of the fan blades of the blower. Because lower volumes of compressed gas are passed through the motor housing at lower speeds below 2000 rpm, the blow-by of gas between the sides of the rotor and the sidewalls of the housing can result in a 20% or greater loss of efficiency in prior art designs, where efficiency is defined as the ability of the motor to convert the energy of the compressed gas into rotary power. Additionally, such prior art motors cannot begin to operate efficiently without the lubricant that is normally present in compressed shop air. While the use of vanes formed from self-lubricating plastic material can ameliorate the frictional problems encountered when the pressurized gas contains no lubricant, the relatively light weight of such vanes can create a sealing problem at low rpm rates, since the centrifugal force that tends to sling the vane into engagement against the inner surface of the housing may not be of sufficient magnitude to create an effective sealing engagement between the vane and the housing interior. Finally, such prior art air motors are not well designed to operate under extremes of temperature which can occur, for example, when the drive gas originates from a cryogen such as liquid carbon dioxide. When such a drive gas is used, the internal components of the motor may be subjected to temperature extremes ranging from −100° F. to +130° F., depending upon the ambient temperature. Under such conditions, the applicants have observed that even if the vanes, the rotor slots, and the internal dimensions of the enclosure are carefully dimensioned in order to minimize inefficiencies caused by blow-by, such dimensioning does not hold up over such a broad range of temperature extremes due to the different thermal coefficients of expansions of the different materials forming these components. Consequently, either binding or excessive slack occurs between the vanes, the rotor slots, and the housing.

Clearly, there is a need for a rotary vane type motor that is capable of efficiently running at low rpm in order to drive certain types of blowers and other devices which operate best at low rpms. Ideally, such a motor would have both a minimum amount of blow-by and a minimum amount of friction during operation. Finally, the internal components of such a motor should continue to accurately interfit and cooperate with one another over a broad range of temperature extremes in the event that a cryogenic gas is used as the drive fluid.

The foregoing illustrates limitations known to exist in present devices and methods. Thus it is apparent that it would be advantageous to provide an alternative directed to overcoming one or more limitations set forth above. Accordingly, a suitable alternative is provided including features more fully disclosed hereinafter.

SUMMARY OF THE INVENTION

The invention is a high efficiency rotary vane motor well adapted to operate at low rpm from a source of pressurized gas, which may be generated from a cryogenic source. The motor comprises a housing that includes a tubular body and a pair of opposing end plates attached thereto for defining a cylindrical enclosure, a rotor having a plurality of radially oriented slots, a plurality of vanes slidably movable within the slots, a shaft for rotatably mounting the rotor in an eccentric position within the housing enclosure, and a means for slidably mounting the rotor to the shaft that transmits power from the rotor to the shaft but yet equilibrates tight clearances between the rotor and side edges of the vanes and the inner surfaces of the side plates of the housing to minimize blow-by while avoiding frictional engagement. The shaft may extend through a bore in the housing, and the slidable mounting means may include an axially oriented groove in one or the other or both of the shaft and said bore and an axially oriented key receivable in the groove.

Additionally, the thermal coefficient of expansion of the material forming the rotor is substantially the same as the thermal coefficient of expansion of the materials forming the vanes and the housing such that a close fit between the vanes and the slot, the rotor, and the housing is maintained over a broad range of temperatures without binding or excessive slack. In the preferred embodiment, the source of pressurized drive fluid that powers the motor is gaseous carbon dioxide produced from vaporized liquid carbon dioxide, and the thermal coefficient of expansion of the materials forming the rotor, vanes, and housing is selected to be substantially the same in a temperature range of between about −100° F to +130° F to accommodate the extremes between the cryogenic gas leaving the motor, and ambient temperature. For example, both the rotor, the housing body, and the end plates may be formed from cast iron, while the vanes may be formed from a polyamide plastic material whose coefficient of thermal expansion is matched to be substantially the same as cast iron.

To ensure an accurate alignment between the off-center shaft openings in the end plates, a pilot structure is provided between the side plates and body of the housing. In the preferred embodiment, the pilot structure is a pair of pilot pins provided in one or the other of the housing body and the plates, and a pair of pilot recesses provided in one or the other of the plates and body. Such a structure prevents the occurrence of a skewed or twisted shaft alignment in the housing which could interfere with the proper sealing actions between the vanes, housing, and side plates.

To ensure a sufficient sealing engagement between the outer edges of the rotor vanes and the inner surface of the housing body, the motor further includes a structure for diverting a portion of the pressurized drive gas from the trailing sides of the vanes to the inner edges thereof to radially push the vanes outwardly from their respective slots into the housing body. In one embodiment, the structure comprises a plurality of chordally-oriented bores extending from the exterior of the rotor to the inner portions of the rotor slots. In another embodiment, this structure comprises a pair of spaced apart grooves present in the trailing face of each of the several vanes. In both embodiments, pressurized gas is effectively conducted to the inner edge of each vane in order to pneumatically push the outer edges of the vane into sealing engagement with the inner surface of the housing body.

To further enhance such sealing contact, the outer edge of each of the vanes is rounded in substantially the same profile as the cylindrical inner surface of the housing body to achieve surface contact (as opposed to line contact) between the outer edges of the vanes and the housing body.

The axial slidability of the rotor, in combination with the matching coefficient of thermal expansion of the materials forming the motor components and the aforementioned pilot and gas conducting structures results in a rotary vane motor that minimizes blow-by losses at low rpm, and is highly efficient even when used with a cryogenic gas containing no lubricant.

The foregoing and other aspects of the invention will become apparent from the following detailed description of the invention when considered in conjunction with the accompanying drawing figures.

BRIEF DESCRIPTION OF THE SEVERAL FIGURES

DETAILED DESCRIPTION OF THE PREFERRED EMBODIMENT

Figure 1:
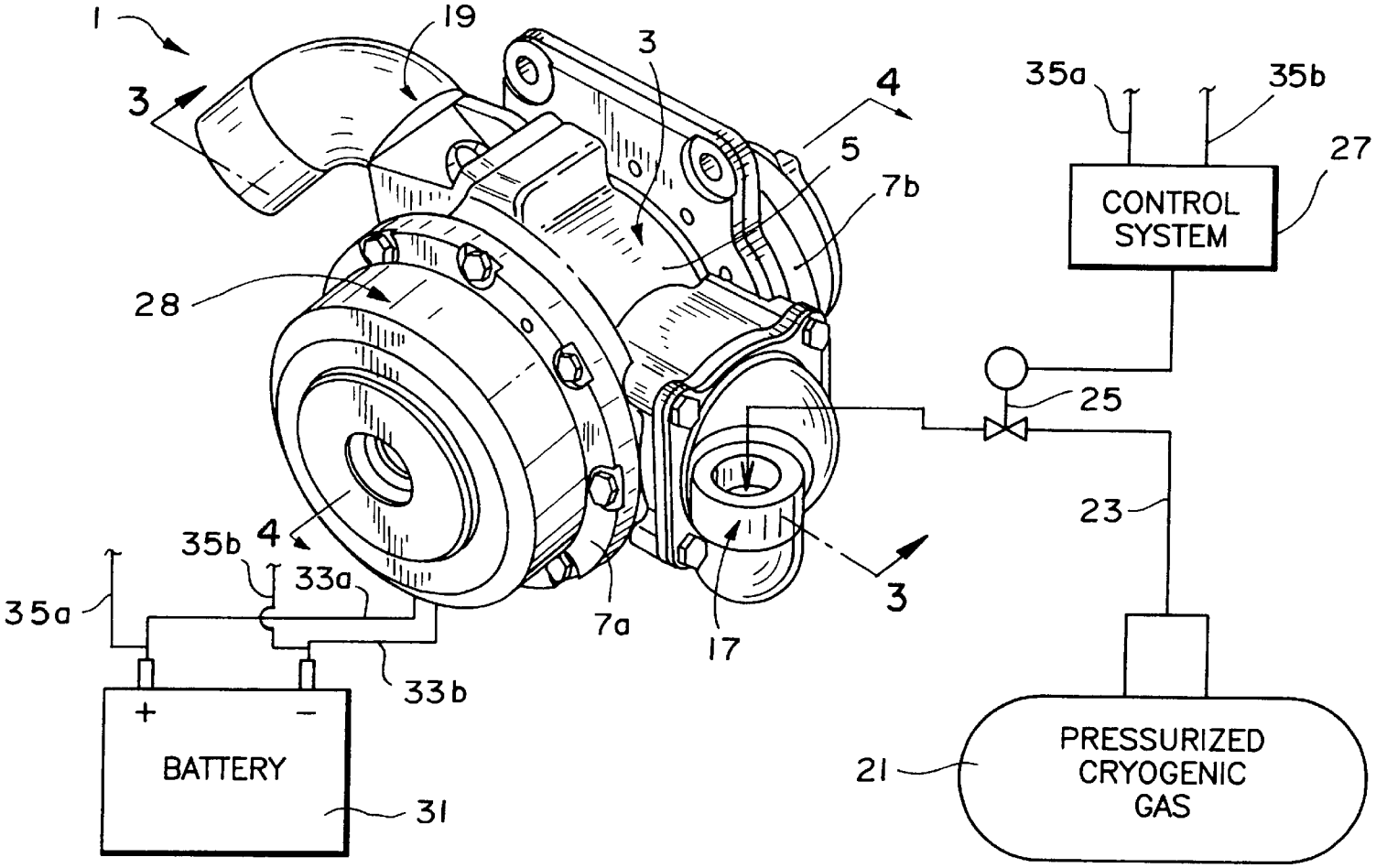
FIG. 1 is a perspective view of the rotary vane motor of the invention, shown in combination with a source of drive fluid in the form of pressurized cryogenic gas.
Figure 2:
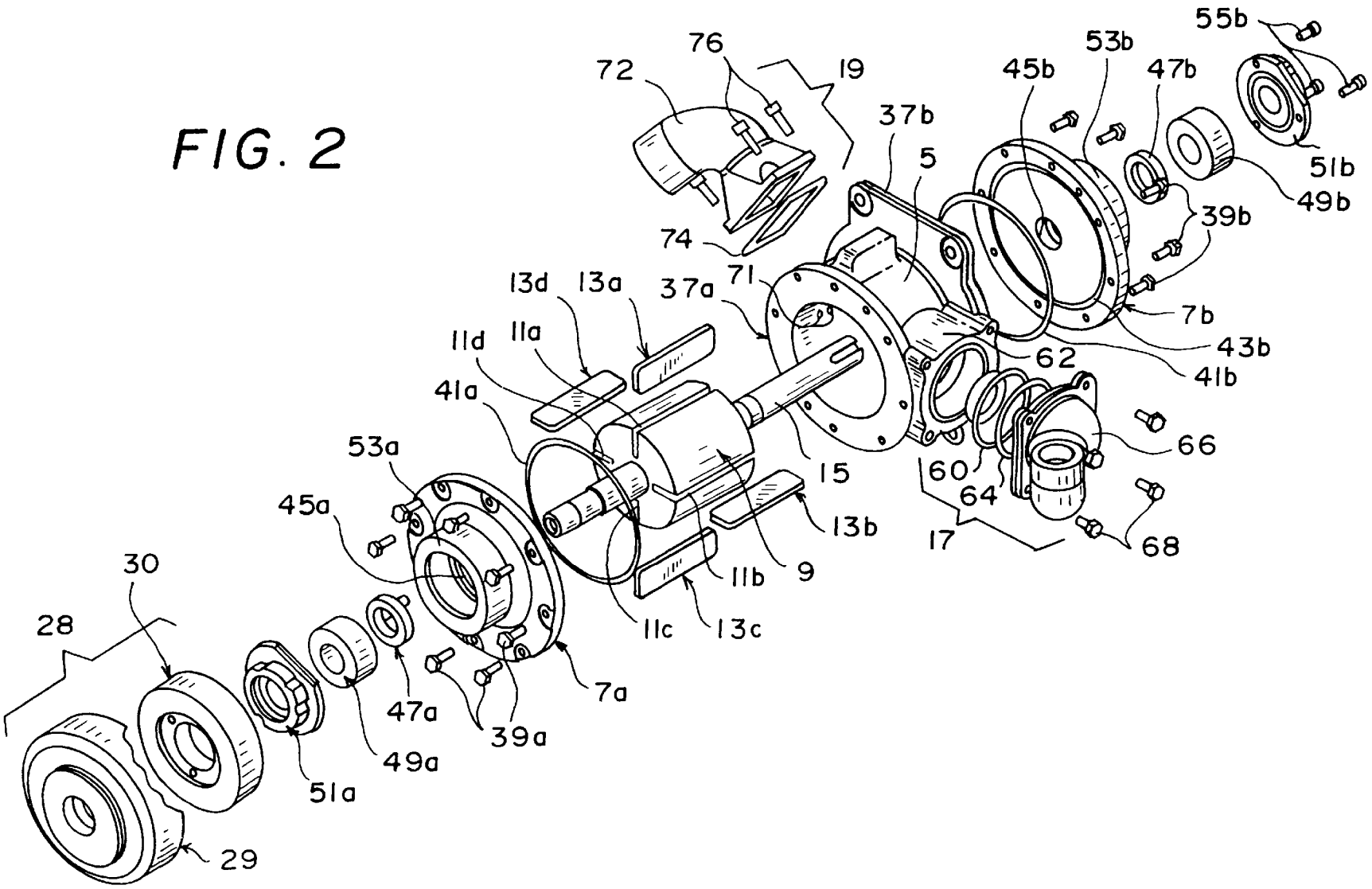
FIG. 2 is an exploded perspective view of the rotary vane motor illustrated in FIG. 1.

With reference to drawing Figures, wherein like numbers designate like components throughout all and particularly FIGS. 1 and 2, the rotary vane motor 1 of the invention generally comprises a housing 3 having an annular body 5, and a pair of circular end plates 7*a,b* bolted at opposing ends thereof. The interior of the housing 3 defines a cylinder that encloses a cylindrical rotor 9. In this example, the rotor 9 includes four radially oriented slots 11*a–d* uniformly spaced around the axis of rotation of the rotor 9 every 90°, although different numbers of slots and vanes could be used as well. In the preferred embodiment, the housing 3 and the rotor 9 are both formed from a ferritic alloy, such as cast iron, for durability, wear resistance, and the fact that the thermal coefficient of expansion of such metals is close to that of commercially available bearing steel. While it would be possible to fabricate these components out of lighter metals, such as aluminum, the relatively greater heat conductivity and higher coefficient of thermal expansion that such metals typically have make them less desirable for use in a rotary vane motor powered by a cryogenic gas since the initial exposure of such metals to gas may cause undesirable localized thermal differential contraction, which in turn can interfere with the smooth functioning of these components.

The motor 1 further includes vanes 13*a–d* slidably disposed within the slots 11*a–d* and the vanes, while shown as substantially rectangular, may be other shapes as well. Because the motor 1 is particularly adapted to be driven by a dry, lubricant-free cryogenic gas, each of the vanes 13*a–d* is preferably formed from a tough, self-lubricating polyamide plastic material. Moreover, in order to maintain a gas tight seal between the side edges of the vanes 13*a–d* and the inner surfaces of the side plates 7*a,b*, each of the vanes 13*a–d* should be formed from a material having substantially the same coefficient of thermal expansion as the cast iron that forms the rotor 9 in the housing body 5. One such polyamide plastic material is available under the tradename of Meldin 3000H, and is available from the Furon Advanced Polymers Division, located in Bristol, R.I. The rotor 9 is slidably mounted on a shaft 15 whose ends are in turn rotatably mounted in the opposing end plates 7*a,b*. As will be discussed in more detail later, the mounting between the shaft 15 and the rotor 9 allows some degree of slidable, axial movement to occur between these components in order to equilibrate the tight clearances between the side edges of the rotor 9 and vanes 13*a–d* and the inner surfaces of the end plates 7*a,b* that obstruct blow-by. Finally, the motor 1 includes an inlet assembly 17 for receiving a drive gas, and an outlet assembly 19 for expelling exhaust drive gas. All of the various components that make up these assemblies 17 and 19 are discussed in more detail hereinafter.

With specific reference now to FIG. 1, the rotary vane motor 1 of the invention is particularly adapted to be driven by a source 21 of pressurized cryogenic gas, such as carbon dioxide, that is generated from liquid carbon dioxide. Such a source 21 is flow connected to the inlet assembly 17 of the motor 1 via an inlet conduit 23. The specific amount of gas allowed to flow into the inlet assembly 17 is modulated by a motor controlled valve 25 which receives signals from a microprocessor-operated control system 27. The rotary vane motor 1 of the invention is particularly designed to drive an evaporator blower (not shown) that operates most efficiently at low rpms, and an alternator 28 having a rotor 29 and stator 30 in order to maintain a charge in a battery 31 which in turn powers the previously mentioned control system. The alternator 28 is connected to the battery via cables 33*a,b*, and the control system 27 is in turn connected to the battery 31 by means of power cables 35*a,b*.

Figure 3:
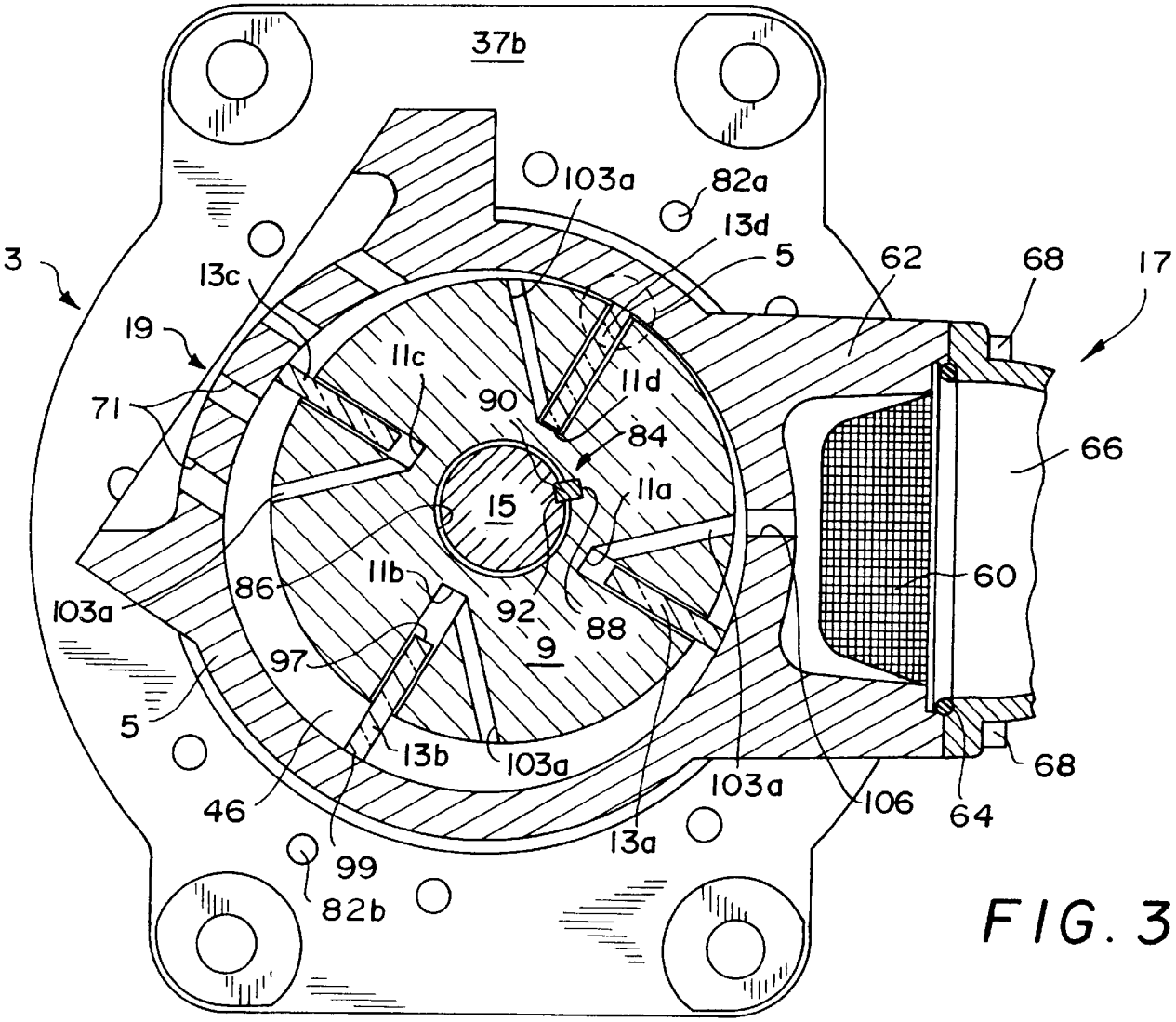
FIG. 3 is a side, cross-sectional view of the rotary vane motor illustrated in FIG. 1 along the line 3—3 as it would appear with the exhaust manifold removed.
Figure 4:
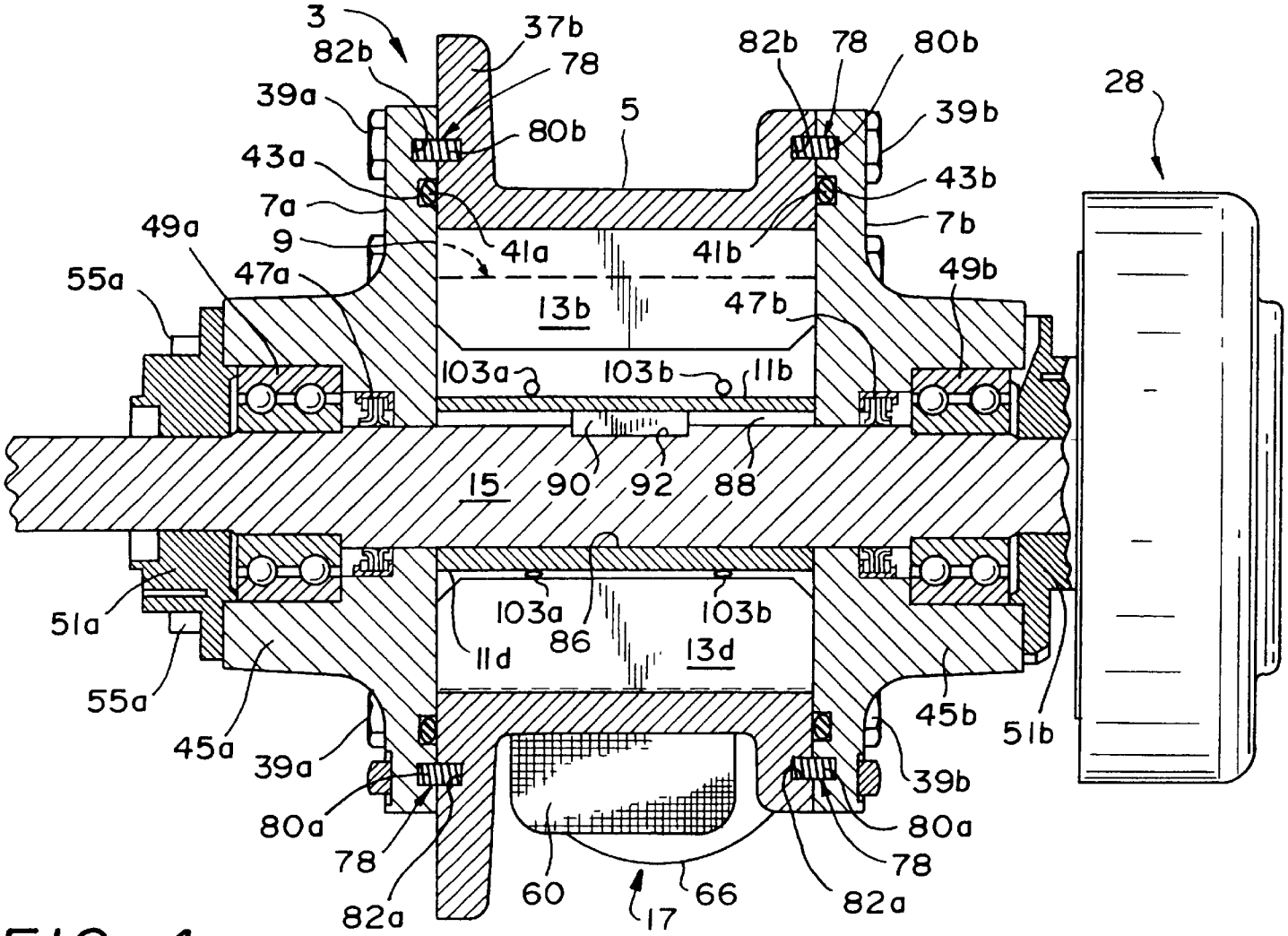
FIG. 4 is a substantially longitudial, cross-sectional view of the rotary vane motor of FIG. 1 along the line 4—4.

With reference now to FIGS. 2 and 4, the outer periphery of each of the end plates 7*a,b* is secured around annular flanges 37*a,b* integrally formed around the edges of the housing body 5 by means of bolts 39*a,b*. In order to ensure a fluid-tight seal between the end plates 7*a,b* and the flanges 37*a,b* of the housing body 5, O-rings 41*a,b* seated in annular grooves 43*a,b* are provided in each of the side plates 7*a,b*. Each of the side plates 7*a,b* includes a bore 45*a,b* for conducting an end of the shaft 15. These bores 45*a,b* are not concentric with respect to either of the circular end plates 7*a,b*, but instead are off-center, such that the rotor 9 is mounted eccentrically with respect to the cylindrical space defined within the housing 3. Such a mounting results in a crescent shaped gap 46 between the rotor 9 and the interior of the housing 3 (as best seen in FIG. 3). In each of the end plates 7*a,b*, the shaft 15 is journaled in an annular seal 47*a,b* in order to prevent pressurized drive gas from escaping through the end plates. Each of the plates further includes a bearing 49*a,b* for rotatably mounting the ends of the shaft 15 with a minimum amount of friction. Each of the bearings 49*a,b* is disposed within an annular shoulder 53*a,b* projecting from the outer face of each of the end plates 7*a,b*, and is secured in this position by means of bearing retainers 51*a,b*. Each of the bearing retainers 51*a,b* is in turn secured onto the annular shoulders 53*a,b* by means of bolts 55*a,b*. The position of the annular seals 47*a,b* and bearings 49*a,b* may be reversed on the shaft if desired.

With reference now to FIGS. 2 and 3, the inlet assembly 17 includes a screen filter cup 60 for filtering out solid debris from the cryogenic gas emanating from the source 21. The filter cup 60 is mounted in an integrally formed, tubular inlet neck 62. An O-ring 64 is disposed around the outer periphery of the filter cup 60 to effect a fluid tight seal between the intake fitting 66 and the inlet neck 62 which are secured together by means of bolts 68. The outlet assembly 19 is formed in part from a plurality of exhaust ports 71 present in a side of the housing body 5 generally opposite that of the inlet assembly 17. An exhaust manifold 19 is bolted over the exhaust ports 71 as indicated in FIG. 2. A gasket 74 is disposed between the bottom of the exhaust manifold 72 and the housing body 5 to prevent leakage therebetween.

Because of the off-center position of the bores 45*a,b* in each of the end plates 7*a,b*, it is extremely important that they be properly aligned with one another with respect to the housing body 5. Otherwise, even a small misalignment can create a skewing or twisting of the shaft 15 with respect to the housing 3, which in turn could cause interference between the rotor 9 and the interior surfaces of the housing 3. To this end, a pilot structure 78 is provided between the end plates 7*a,b* and the annular flanges 37*a,b* integrally formed around the side edges of the housing body 5. These pilot structures 78 are formed from pilot pins 80*a,b* mounted in the annular flanges 37*a,b* of the housing body 5 which are registrable with and insertable into pilot bores 82*a,b* present in the end plates 7*a,b*. The provision of such pilot structures 78 insures an axial alignment between the shaft-conducting bores 45*a,b* of the opposing end plates 7*a,b*.

With reference now to FIGS. 3 and 4, a slidable connection 84 is provided between the rotor 9 and the shaft 15 in order to equilibrate the small gas obstructing clearances between the side edges of the vanes 13*a–d* and rotor 9 and the inner surfaces of the end plates 7*a,b*. The slidable connection 84 includes an axial bore 86 that is concentrically aligned with the axis of rotation of the rotor 9. This bore 86 is closely dimensioned to the outer diameter of the shaft 15 in order to receive the shaft with little or no radial play between the outer diameter of the shaft 15 and the inner diameter of the bore 86. A radially oriented groove 88 is disposed along the longitudinal axis of the axial bore 86 as shown in FIG. 4. This groove 88 receives a complementarily shaped key 90 which in turn is inserted in a longitudinally oriented slot 92 present in the midsection of the shaft 15. In operation, the key 90 transmits torque from the rotor 9 to the shaft 15. However, the sliding fit between the key 90 and the axially oriented groove 88 allows the rotor 9 to compliantly move between the inner surfaces of the end plates 7*a,b* as the rotor 9 rotates.

Figure 5:
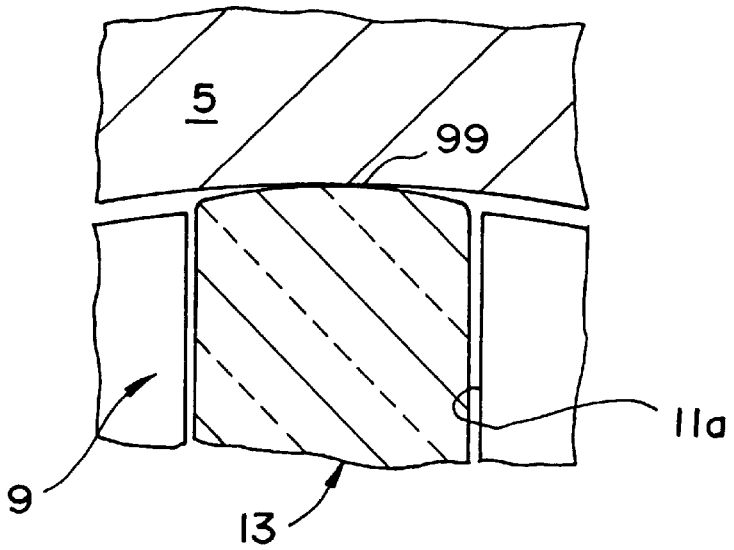
FIG. 5 is an enlargement of the area enclosed in the dotted circle in FIG. 3, illustrating how the rounded profile of the outer edges of the vanes allows the vanes to wipingly engage the inner surface of the housing body in surface-to-surface (as opposed to line) contact.
Figure 6:
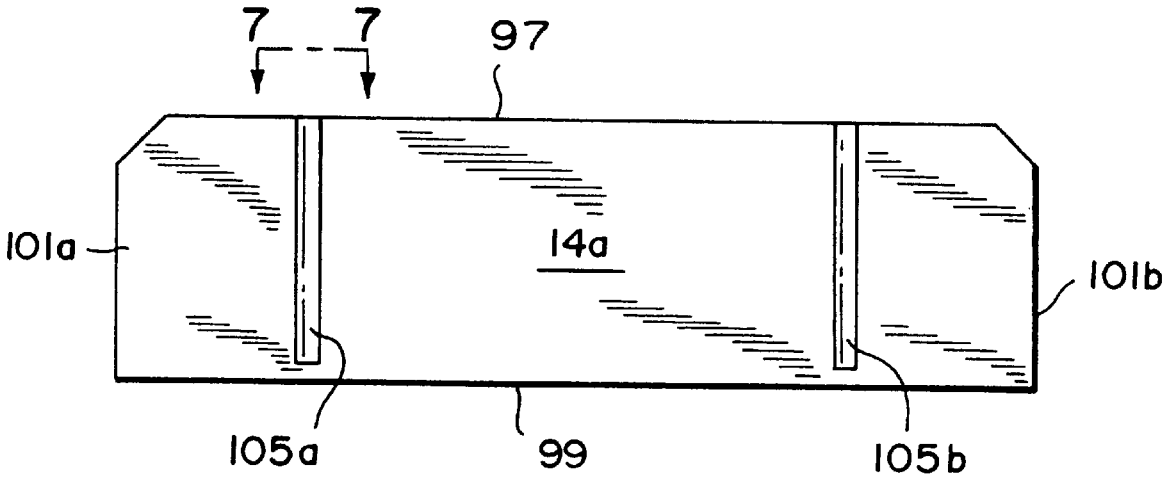
FIG. 6 is a plan view of the trailing side of a vane used in a second embodiment of the invention, wherein gas conducting bores in the rotor are replaced by gas conducting grooves in the vanes.

With reference now to FIGS. 3, 5 and 6, each of the vanes 13*a–d* includes an inner edge 97 disposed near the center of the rotor 9, and an outer edge 99 that slidingly and sealingly engages the cylindrical inner surface of the housing body 5. In order to maximize sealing contact between the vanes 13*a–d* and the inner surface of the housing body 5, the outer edge 99 of each of the vanes 13*a–d* has a rounded profile (as seen in FIG. 5) which is partially complementary in shape to the rounded profile of the inner surface of the housing body 5. Such dimensioning results in the attainment of surface (as opposed to line) contact between the outer edges 99 of the vanes 13*a–d*, and the inner surface of the housing body 5. To insure that the rounded outer edges 99 will engage the inner surface of housing body 5 with sufficient force to effect a seal, chordally-oriented gas conducting bores 103*a,b*. (not shown in FIG. 3) are provided in the rotor between the outer surface thereof, and the inner ends of the slots 11*a–d*. Each pair of bores 103*a,b* is located adjacent to the trailing side of the vanes 13*a–d* in order to divert a small portion of the pressurized drive gas through the rotor 9 and against the inner edges 97 of the vanes 13*a–d*. The pressure that the drive gas applies to the inner edges 97 of the vanes 13*a–d* causes the outer edges 99 thereof to engage the inner surface of the housing body 5 more forcefully than if the bores 103*a–d* were not present. This is an important feature of the invention, for two reasons. First, because the vanes 13*a–d* are formed from a relatively light weight plastic material, instead of metal, there is a relatively smaller amount of centrifugal force acting to sling the outer edges of the vanes against the inner surface of the housing body 5 to achieve fluid tight contact. Secondly, this centrifugal force is further diminished by the low rotational speed of the rotary vane motor 1 which is designed to be operated at speeds less than 2,000 rpm, and preferably under 1,500 rpm.

Figure 7:
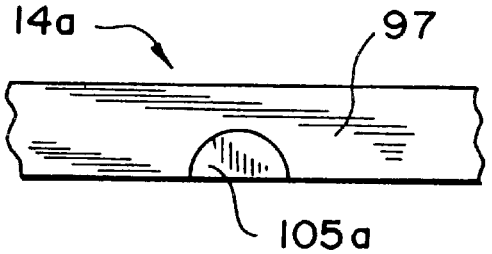
FIG. 7 is an enlarged view of the inner edge of the vane illustrated in FIG. 6 along the line 7—7, illustrating the semicircular cross-section of the gas conducting grooves.

FIGS. 6 and 7 illustrate a second embodiment of the invention which is identical in all respects to the previously described embodiment, which the exception that the rotor 9 does not include the previously described gas conducting bores 103*a,b*. Instead, modified vanes 14*a–d* are used (of which only 14*a* is illustrated) in which gas conducting grooves 105*a,b* are provided on either side. As is illustrated in FIG. 7 these grooves extend all the way from the inner edge 97 of each of the vanes 14*a–d* until almost to the outer edge 99. While the grooves 105*a,b* are illustrated as having a semicircular cross section, such a shape is not critical. These grooves 105*a,b* are present on the trailing side of each of the vanes 14*a–d*, and, like the previously described gas conducting bores 103*a,b* and the rotor 9, serve to conduct compressed drive gas upwardly through the slots receiving each of the vanes 14*a–d* such that pressurized drive gas comes to bear on the inner edge 97 of each vane 14*a–d*. Vane grooves 105*a* and 105*b* are closed at respective ends 109*a* and 109*b* adjacent outer edge 99.

The operation of the rotary vane motor 1 of the invention will now be described with respect to FIG. 3. When a drive fluid such as compressed, cryogenic gas is admitted through the inlet assembly 17, such gas flows through inlet port 106 and into one side of the crescent-shaped gap 46 between the cylindrical rotor 9, and the interior of the housing 3. The pressurized gas contained between vanes 13*d* and 13*a* pushes against the trailing side of the vane 13*a*, causing the rotor 9 to rotate. As the rotation proceeds, the gas expands to fill the greater volume located toward the mid-section of the crescent shaped gap 46. At the same time, a portion of this compressed drive gas is diverted through gas conducting bores 103*a,b* into the slot 11*a* which slidably receives the vane 13*a*. This causes the outer edge 99 of the vane 13*a* to sealingly engage against the inner surface of the housing body 5 in the manner previously described. Key 88 transmits the rotational movement of the rotor 9 to the shaft 15, which in turn performs useful work, i.e., by the operation of a blower and an alternator 28. As the vane 13*a* continues its rotational movement around the crescent shaped gap 46, it slidably extends radially outwardly due to the pressure applied to its inner edge 97 by compressed gases led thereto by means of bores 103*a,b*. Expansion and work output continues until the trailing side of the vane 13*a* moves just past the first exhaust ports 71. At this juncture, the pressurized drive gas has completed its useful work on the trailing side of the vane, and is exhausted out through exhaust ports 71, where it is ultimately led away from the motor 1 via manifold 72. During this step in the operation of the motor 1, the vane 13*a* begins to slide radially inwardly, assuming the position illustrated with respect to 13*c* and then 13*d*, which is the closest position between the rotor 9 and the inside of the surface of the housing body 5. Gas pressure and centrifugal force cause the vane to reassume the position illustrated with respect to 13*a* in FIG. 3, and the cycle is repeated. All during the rotation of the rotor 9, the side edges 101*a,b* of each of the vanes maintain an equal and close clearance to the inner surfaces of the end plates 7*a,b*. Because of the slidable connection 84 between the rotor 9 and the shaft 15, the clearances between rotor 9 and the sides of the end plates 7*a,b* are continuously equilibrated thereby ensuring a minimum amount of blow-by losses and friction.

To further enhance the overall efficiency and operation of the motor 1, the gap between the rotor 9 and its closest point with respect to the inner surface of the housing body 5 should be as small as possible, and preferably on the order of 0.0015 inches. Moreover, total end play between the rotor and the end plates should be between about 0.001 and 0.003 inches. The interior of the housing body 5 and end plates 7*a,b* should have about an eight micro inch finish hard coated to about Rockwell C58. These surfaces should be coated with commercially available, friction reducing finishes such as electroless nickel or plasma sprayed with molybdenum and Teflon® impregnated. Finally, the surface finish of the rotor slots 11*a–d* should be controlled to be within an approximately 32 micro inch finish to reduce friction with the vanes 13*a–d*. While this invention has been illustrated and described in accordance with the preferred embodiment, it is recognized that variations and changes may be made therein without departing from the invention as set forth in the claims.

What is claimed:

1. A high efficiency rotary vane motor comprising:

a housing including a body, and a pair of opposing end plates attached thereto for defining an enclosure;

a cylindrical rotor having a first rotor end, a second rotor end, an axially extending rotor slot extending between the two rotor ends, and a plurality of radially oriented slots, said rotor being slidably mounted on a shaft, said shaft having an axial slot intermediate the shaft ends, the shaft slot having closed ends, wherein said shaft transmits rotary power from said rotor through at least one of said end plates;

a key member having a portion located in the shaft slot and a portion slidable through the axial rotor slot so that the rotor is locatable at the requiredocation in the enclosure to achieve equilibrating clearances between side edges of said vanes and said rotor and inner surfaces of said end plates;

a plurality of vanes slidably movable within said slots, each of said vanes having an inner vane edge, an outer vane edge and leading and trailing faces joining the inner and outer vane edges, the vanes including at least one gas conducting slot extending from an inlet end at the inner vane edge to a closed end proximate the outer vane edge, each of said gas conducting slots adapted to radially push the vanes outwardly from their respective vane slots; and means for rotatably mounting said rotor in an eccentric position within said housing enclosure.

2. The high efficiency rotary vane motor defined in claim 1, the motor further comprising pilot means between said end plates and said housing body for accurately aligning end plate rotatable shaft mountings, and wherein said pilot means includes at least one pilot pin disposed in pilot bores present between said housing body, and said end plates.

3. The high efficiency rotary vane motor defined in claim 1, wherein said housing body includes a substantially cylindrical inner surface, and wherein each of said vanes includes a rounded outer edge that substantially conforms to the circular profile of said inner surface to enhance fluid sealing contact therebetween.

4. The high efficiency rotary vane motor defined in claim 1, wherein the thermal coefficient of expansion of the material forming the rotor is substantially the same as the thermal coefficient of expansion of the material forming the vanes such that a close fit between said vanes and said radially oriented slots is maintained over a broad temperature range without binding.

5. The high efficiency rotary vane motor defined in claim 4, wherein the thermal coefficient of expansion of the material forming said rotor and the material forming said vanes is substantially the same in a temperature range of between about −100° F. to +130° F.

6. The high efficiency rotary vane motor defined in claim 5, wherein the rotor is formed from a ferritic alloy, and the vanes are each formed from a polyamide plastic material.

7. The high efficiency rotary vane motor defined in claim 5, wherein the thermal coefficient of expansion of the material forming the housing body is substantially the same as that of the material forming the rotor and the material forming the vanes.

8. The high efficiency rotary vane motor defined in claim 1, wherein said vanes are formed from a plastic material to reduce friction and obviate the need for a lubricant.

9. The high efficiency rotary vane motor system defined in claim 8, wherein the source of pressurized drive fluid is a pressurized cryogenic gas and thermal coefficient of expansion of the material forming the rotor is substantially the same as the thermal coefficient of expansion of the material forming the vanes such that a close fit between said vanes and said radially oriented slots is maintained over a broad range of temperature without binding.

10. The high efficiency rotary vane motor defined in claim 9, wherein the rotor is formed from cast iron, and the vanes are each formed from a polyamide plastic material.

11. The high efficiency rotary vane motor as claimed in claim 1 wherein the at least one gas conducting slot is provided on the vane trailing face.

12. The high efficiency rotary vane motor as claimed in claim 11 wherein each vane includes two gas conducting slots each gas conducting slot having a semicircular cross section.

* * * * *